US009862068B2

(12) United States Patent
Ogiwara et al.

(10) Patent No.: US 9,862,068 B2
(45) Date of Patent: Jan. 9, 2018

(54) WORKPIECE HOLDING JIG FOR VIBRATORY BARRELING, AND VIBRATORY BARRELING METHOD

(71) Applicant: SINTOKOGIO, LTD., Nagoya-shi, Aichi (JP)

(72) Inventors: Naoyuki Ogiwara, Kitanagoya (JP); Shigeru Tanahashi, Ama-gun (JP)

(73) Assignee: SINTOKOGIO, LTD., Nagoya-shi, Aichi (JP)

( * ) Notice: Subject to any disclaimer, the term of this patent is extended or adjusted under 35 U.S.C. 154(b) by 52 days.

(21) Appl. No.: 14/906,933

(22) PCT Filed: Jun. 19, 2014

(86) PCT No.: PCT/JP2014/066336
§ 371 (c)(1),
(2) Date: Jan. 22, 2016

(87) PCT Pub. No.: WO2015/015940
PCT Pub. Date: Feb. 5, 2015

(65) Prior Publication Data

US 2016/0151878 A1 Jun. 2, 2016

(30) Foreign Application Priority Data

Jul. 30, 2013 (JP) ..... 2013-157888

(51) Int. Cl.
*B24B 31/06* (2006.01)
*B24B 31/12* (2006.01)
*B24B 31/073* (2006.01)

(52) U.S. Cl.
CPC ..... *B24B 31/064* (2013.01); *B24B 31/073* (2013.01); *B24B 31/12* (2013.01)

(58) Field of Classification Search
CPC ..... B24B 31/064; B24B 31/073; B24B 31/12; B24B 1/00; B24B 37/042; B24B 31/00; B24C 1/04; A61F 2/16
(Continued)

(56) References Cited

U.S. PATENT DOCUMENTS 2,785,513 A * 3/1957 Shafer, Jr. ..... B24B 31/02 241/170
3,464,163 A * 9/1969 Ferrara ..... B24B 31/064 451/106
(Continued)

FOREIGN PATENT DOCUMENTS

CN 86201729 12/1986
CN 1075274 8/1993
(Continued)

OTHER PUBLICATIONS

International Preliminary Report on Patentability dated Feb. 11, 2016 for PCT/JP2014/066336.

*Primary Examiner* — George Nguyen
(74) *Attorney, Agent, or Firm* — Drinker Biddle & Reath LLP

(57) ABSTRACT

A workpiece holding jig is a vibratory barreling jig which holds a flat workpiece when the workpiece is polished by a vibratory barreling device using polishing media. The workpiece holding jig includes disk-shaped guard members and each having an outer shape larger than the workpiece and disposed so as to face each other and a holding member holding the workpiece inside a housing space so that the entire workpiece is located inside the columnar housing space. The guard members and are respectively provided with window portions communicating with the housing space. The window portions and the annular imaginary curved surface extending to connect the peripheral edges of the guard members are configured to allow the polishing media to pass between the inside and outside of the housing space.

16 Claims, 4 Drawing Sheets

Figure 1:
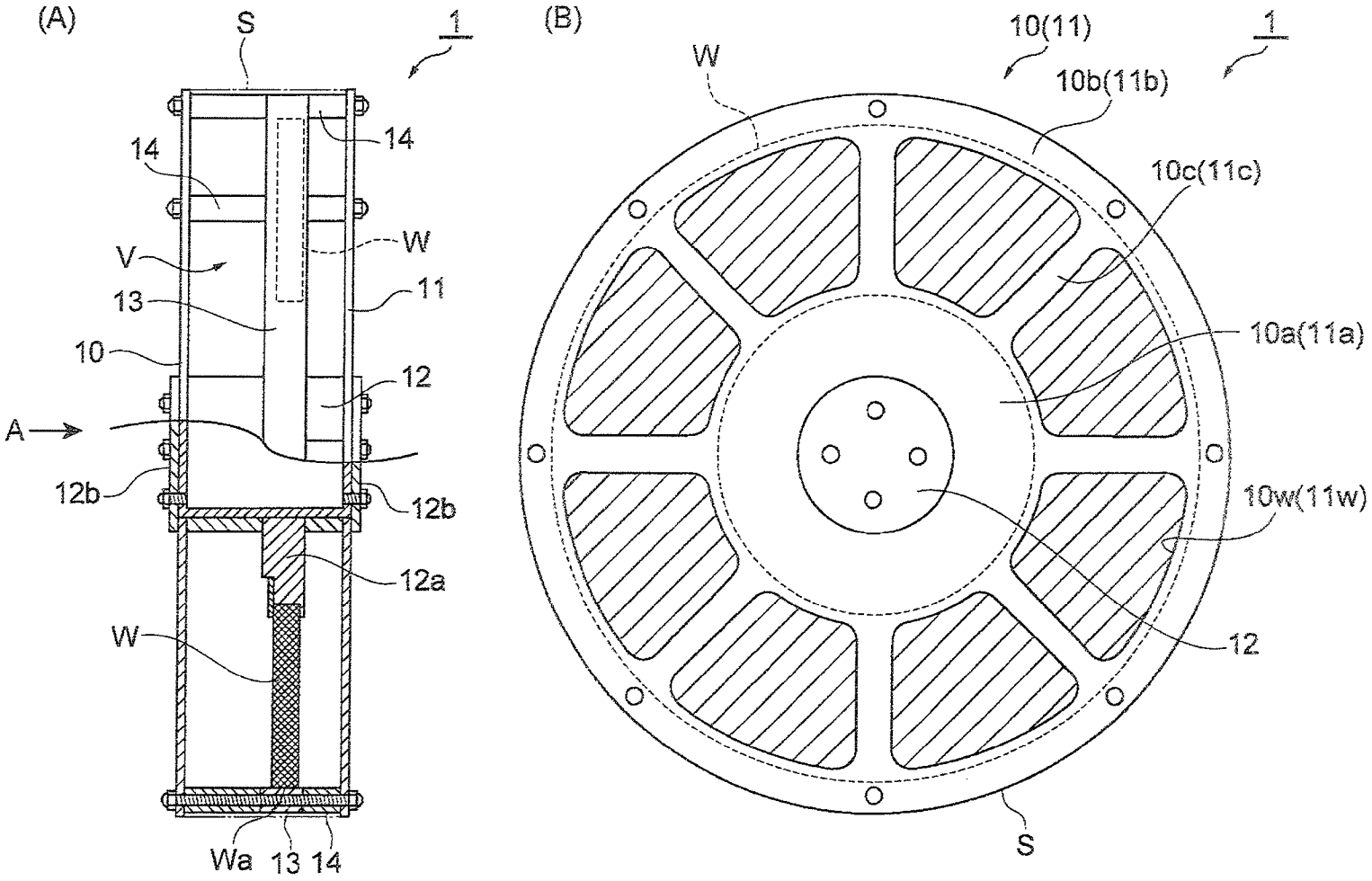

(58) Field of Classification Search
USPC ..... 451/29–32
See application file for complete search history.

(56) References Cited

U.S. PATENT DOCUMENTS

| | | | | |
|---|---|---|---|---|
| 4,447,992 | A * | 5/1984 | Bergquist | B24B 31/12 451/29 |
| 4,530,861 | A * | 7/1985 | Sippel | B05B 15/045 118/503 |
| 5,538,461 | A | 7/1996 | Tseng | |
| 2014/0003951 | A1* | 1/2014 | Soucy | B29C 67/0077 416/223 A |
| 2014/0003952 | A1* | 1/2014 | Cheah | B24B 31/06 416/223 A |

FOREIGN PATENT DOCUMENTS

| | | | | |
|---|---|---|---|---|
| CN | 102240957 | | 11/2011 | |
| CN | 102248474 | | 11/2011 | |
| DE | 2344639 | A1 | 3/1975 | |
| EP | 2289666 | A2 * | 3/2011 | B24B 31/00 |
| JP | H04-75867 | A | 3/1992 | |
| JP | 2000-280162 | A | 10/2000 | |
| RU | 2008111463 | | 10/2009 | |

* cited by examiner

WORKPIECE HOLDING JIG FOR VIBRATORY BARRELING, AND VIBRATORY BARRELING METHOD

CROSS REFERENCE TO RELATED APPLICATIONS

This application is based upon and claims the benefit of priority from Japanese Patent Application No. 2013-157888, filed on Jul. 30, 2013, the entire contents of which are incorporated herein by reference.

TECHNICAL FIELD

The present disclosure relates to a workpiece holding jig for vibratory barreling and a vibratory barreling method.

BACKGROUND ART

Patent Literature 1 discloses a vibratory barreling device which polishes a surface of a workpiece as a polishing target at a predetermined surface roughness or removes burr or oxide coating therefrom. The vibratory barreling device includes a barreling tank which has a U-shaped cross-section and a driving unit which drives the barreling tank so as to shake the barreling tank. In order to polish the workpiece by using the vibratory barreling device, the workpiece, polishing media, and a polishing solution are inserted into the barreling tank, and the barreling tank is shaken along a circular-arc path by the driving unit. Accordingly, the workpiece and the polishing media move relative to each other so that the workpiece is polished.

CITATION LIST

Patent Literature

Patent Literature 1: JP 2000-280162 A

SUMMARY OF INVENTION

Technical Problem

When the workpiece collides with the barreling tank during the polishing operation, an impact force is applied to the workpiece. At this time, there is a concern that the workpiece may be deformed or the surface of the workpiece may be scratched. Particularly, in recent years, there has been a demand for polishing a large workpiece by using the vibratory barreling device. When the large workpiece collides with the barreling tank, a large impact force is applied to the workpiece due to the weight thereof. As a result, there is a concern that a defect may occur in the workpiece.

Here, the present disclosure relates to a workpiece holding jig for vibratory barreling and a vibratory barreling method capable of suppressing any defect by protecting a workpiece when the workpiece is polished by a vibratory barreling device.

Solution to Problem

A workpiece holding jig for vibratory barreling according to one aspect of the present disclosure is configured to hold a flat workpiece when the workpiece is polished by a vibratory barreling device using polishing media, the workpiece holding jig for vibratory barreling including: disk-shaped first and second guard members each having an outer shape larger than the workpiece and disposed so as to face each other; and a holding member holding the workpiece inside a housing space so that the entire workpiece is located inside the columnar housing space surrounded by the first guard member, the second guard member and an annular imaginary curved surface extending connecting the peripheral edges of the first and second guard members, wherein each of the first and second guard members is provided with a first window portion communicating with the housing space, and wherein the imaginary curved surface and the first window portion are configured to allow the polishing media to pass between the inside and outside of the housing space.

In the workpiece holding jig according to the aspect of the present disclosure, the holding member holds the workpiece inside the housing space so that the entire workpiece is located inside the housing space surrounded by the disk-shaped first and second guard members each having an outer shape larger than the workpiece and the annular imaginary curved surface extending to connect the peripheral edges of the first and second guard members to each other. Therefore, the workpiece remains inside the housing space while not protruding from the workpiece holding jig. Thus, it is possible to prevent the collision between the workpiece and the barreling tank even when the workpiece holding jig is disposed in the barreling tank of the vibratory barreling device and the barreling tank is shaken by the vibratory barreling device. As a result, it is possible to suppress any defect by protecting the workpiece when the workpiece is polished by the vibratory barreling device. Further, in the workpiece holding jig according to this aspect of the present disclosure, the disk-shaped first and second guard members each having an outer shape larger than the workpiece are disposed so as to face each other. Therefore, the workpiece holding jig has a columnar outer shape. Thus, when the workpiece holding jig is disposed inside the barreling tank while the workpiece holding jig stands alone inside the barreling tank so that the peripheral edges of the first and second guard members contact the bottom wall of the barreling tank, the workpiece holding jig rolls while standing alone inside the barreling tank. Here, each of the first and second guard members is provided with the first window portion communicating with the housing space. The imaginary curved surface and the first window portion are configured to allow the polishing media to pass between the inside and outside of the housing space. Therefore, it is possible to cause the polishing media to easily flow inside the workpiece holding jig while effectively rolling the workpiece holding jig. As a result, it is possible to extremely efficiently polish the workpiece.

The holding member may hold the workpiece so that the main surface of the workpiece faces each of the first and second guard members, and the first window portion may be formed at a position facing a polishing target area for polishing by the polishing media in the main surface of the workpiece. In this case, the polishing media pass through the first window portion and are mainly guided to the polishing target area of the workpiece. Thus, it is possible to efficiently polish the polishing target area of the workpiece.

The workpiece holding jig for vibratory barreling may further include a covering member covering a non-polishing target area not polished by the polishing media in the workpiece. In this case, since the workpiece holding jig is provided with the covering member, there is no need to directly attach the covering member to the workpiece at a position as the non-polishing area of the workpiece. Thus, it is possible to set a desired non-polishing area just by holding the workpiece in the workpiece holding jig.

A gap between the peripheral edge of the workpiece and the imaginary curved surface may be set to be larger than the outer shape of the polishing media. In this case, the flow of the polishing media is not easily disturbed in the vicinity of the peripheral edge of the workpiece. Thus, it is possible to efficiently polish even the peripheral edge of the workpiece.

The workpiece holding jig for vibratory barreling may further include a connection member extending between the peripheral edges of the first and second guard members and connecting the first and second guard members to each other, wherein the connection member is provided with a second window portion communicating with the housing space, and wherein the second window portion is configured to allow the polishing media to pass between the inside and outside of the housing space. In this case, the first and second guard members are integrated with each other by the connection member. Therefore, it is possible to improve the strength of the workpiece holding jig. Further, since the connection member is provided with the second window portion, the second window portion is configured to allow the polishing media to pass between the inside and outside of the housing space. Therefore, it is possible to cause the polishing media to easily flow inside the workpiece holding jig. As a result, it is possible to extremely efficiently polish the workpiece.

A vibratory barreling method according to another aspect of the present disclosure includes: holding the workpiece in the holding member of the workpiece holding jig; disposing the workpiece holding jig inside a barreling tank while the workpiece holding jig stands alone inside the barreling tank so that the peripheral edges of the first and second guard members contact the bottom wall of the barreling tank of the vibratory barreling device; and causing the vibratory barreling device to shake the barreling tank so that the polishing media flow between the inside and outside of the housing space through the imaginary curved surface and the first window portion while the workpiece holding jig rolls inside the barreling tank in a state where the workpiece holding jig stands alone inside the barreling tank.

In the vibratory barreling method according to another aspect of the present disclosure, the holding member holds the workpiece so that the entire workpiece is located inside the housing space surrounded by the disk-shaped first and second guard members each having an outer shape larger than the workpiece and the annular imaginary curved surface extending to connect the peripheral edges of the first and second guard members to each other. Therefore, the workpiece remains inside the housing space while not protruding from the workpiece holding jig. Thus, it is possible to prevent the collision between the workpiece and the barreling tank even when the vibratory barreling device shakes the barreling tank while the workpiece is disposed inside the barreling tank so that the imaginary curved surface contacts the bottom wall of the barreling tank of the vibratory barreling device. As a result, it is possible to suppress any defect by protecting the workpiece when the workpiece is polished by the vibratory barreling device. Further, in the vibratory barreling method according to another aspect of the present disclosure, the disk-shaped first and second guard members each having an outer shape larger than the workpiece are disposed so as to face each other. Therefore, the workpiece holding jig has a columnar outer shape. Thus, when the workpiece holding jig is disposed inside the barreling tank while the workpiece holding jig stands alone inside the barreling tank so that the peripheral edges of the first and second guard members contact the bottom wall of the barreling tank, the workpiece holding jig rolls while standing alone inside the barreling tank. Further, in the vibratory barreling method according to another aspect of the present disclosure, the polishing media flow between the inside and outside of the housing space through the imaginary curved surface and the first window portion. Therefore, it is possible to cause the polishing media to easily flow inside the workpiece holding jig while effectively rolling the workpiece holding jig. As a result, it is possible to extremely efficiently polish the workpiece.

Advantageous Effects of Invention

According to the workpiece holding jig for vibratory barreling and the vibratory barreling method of the present disclosure, it is possible to suppress any defect by protecting the workpiece when the workpiece is polished by the vibratory barreling device.

BRIEF DESCRIPTION OF DRAWINGS (A) of FIG. 1 illustrates a state where a workpiece holding jig which holds a workpiece and is partially cut is viewed from the lateral side thereof and (B) of FIG. 1 illustrates a state where the workpiece holding jig illustrated in (A) of FIG. 1 is viewed from a direction indicated by the arrow A of (A) of FIG. 1.

Figure 2:
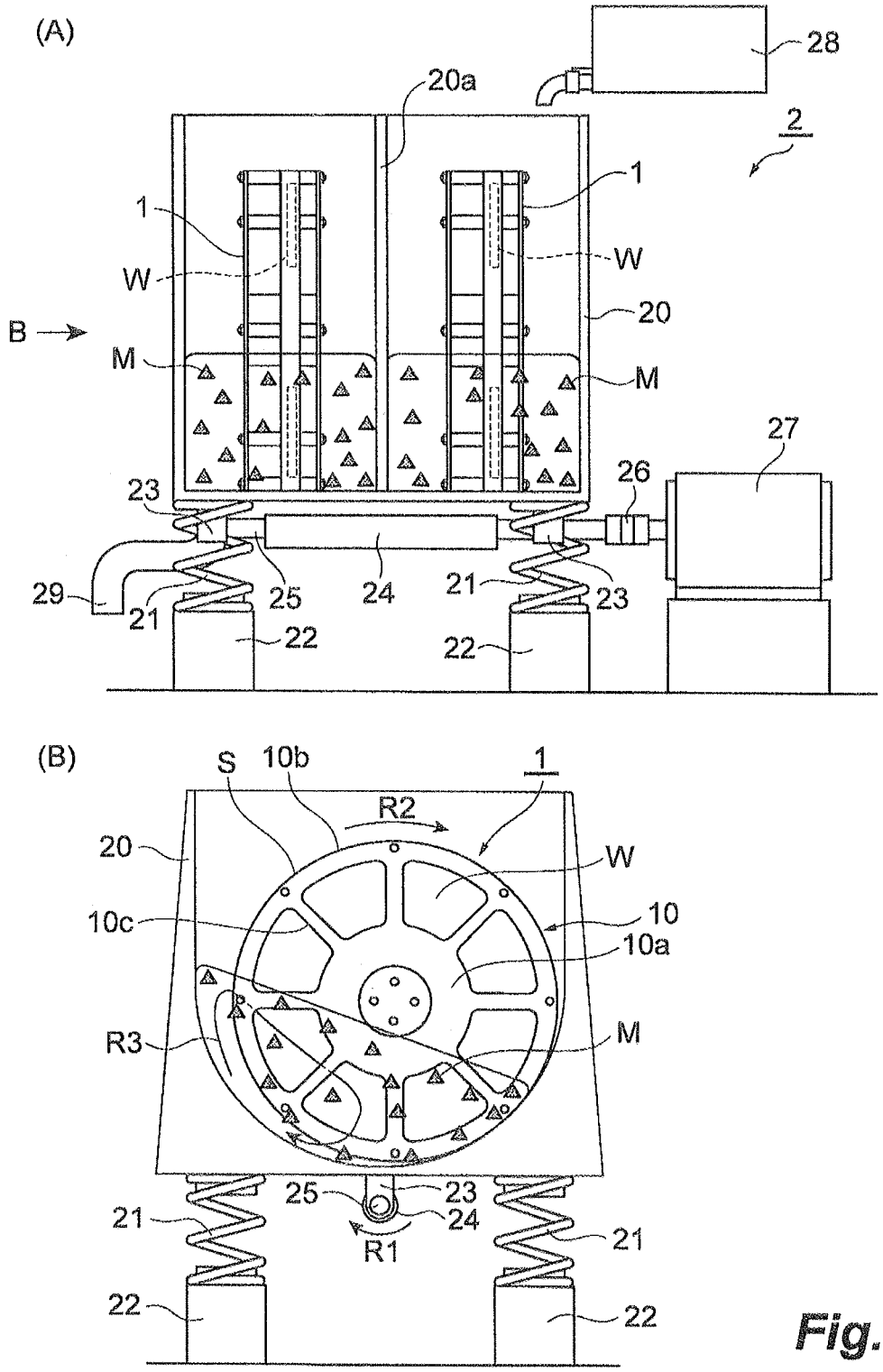

(A) of FIG. 2 illustrates a state where a vibratory barreling device which is partially cut is viewed from a lateral side thereof and (B) of FIG. 2 illustrates a state where the vibratory barreling device which is partially cut is viewed from a direction indicated by the arrow B of (A) of FIG. 2.

Figure 3:
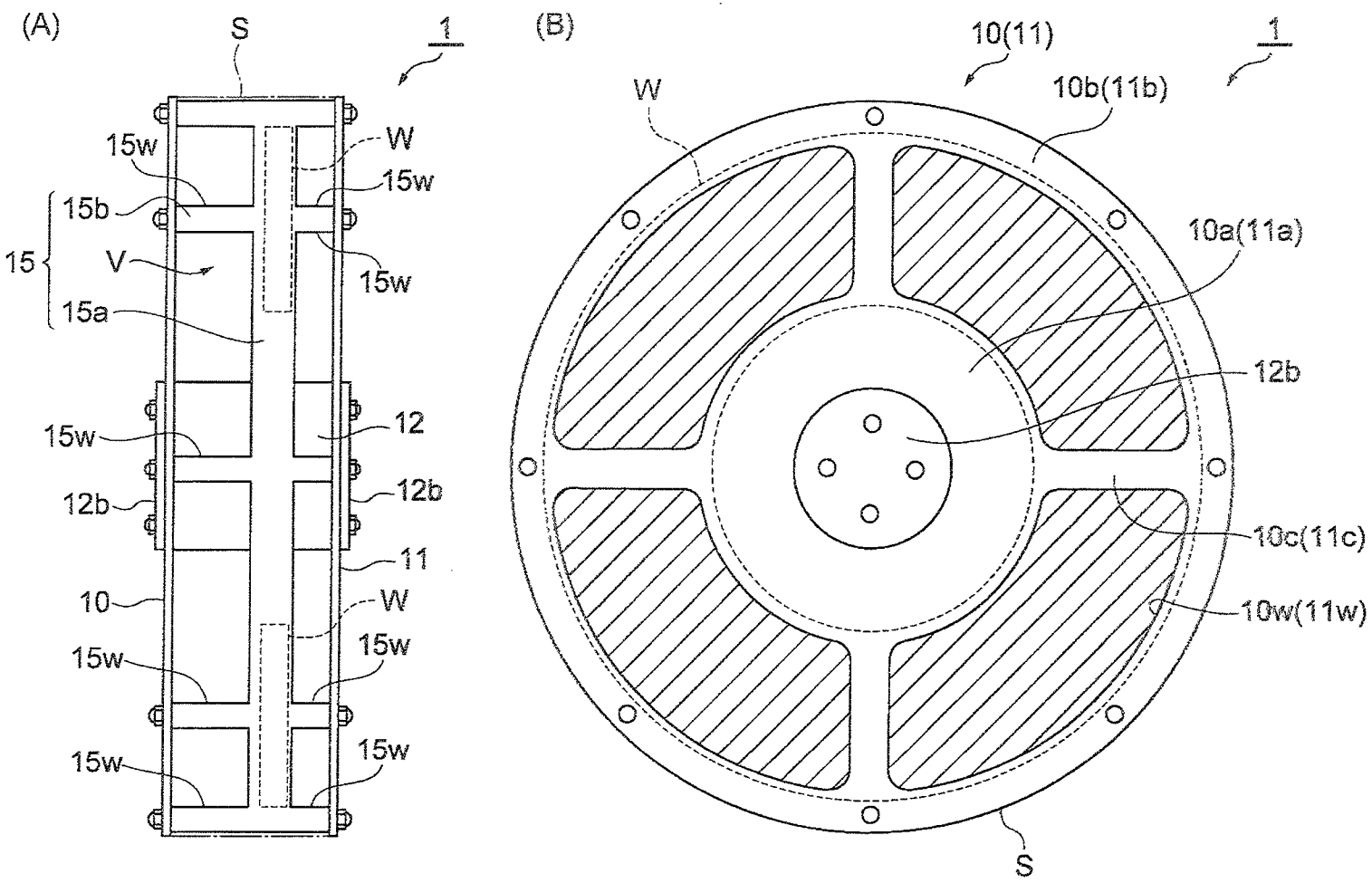

(A) of FIG. 3 illustrates a state where another example of a workpiece holding jig which holds a workpiece is viewed from the lateral side thereof and (B) of FIG. 3 illustrates a state where another example of the workpiece holding jig illustrated in (A) of FIG. 3 is viewed from the front side thereof.

Figure 4:
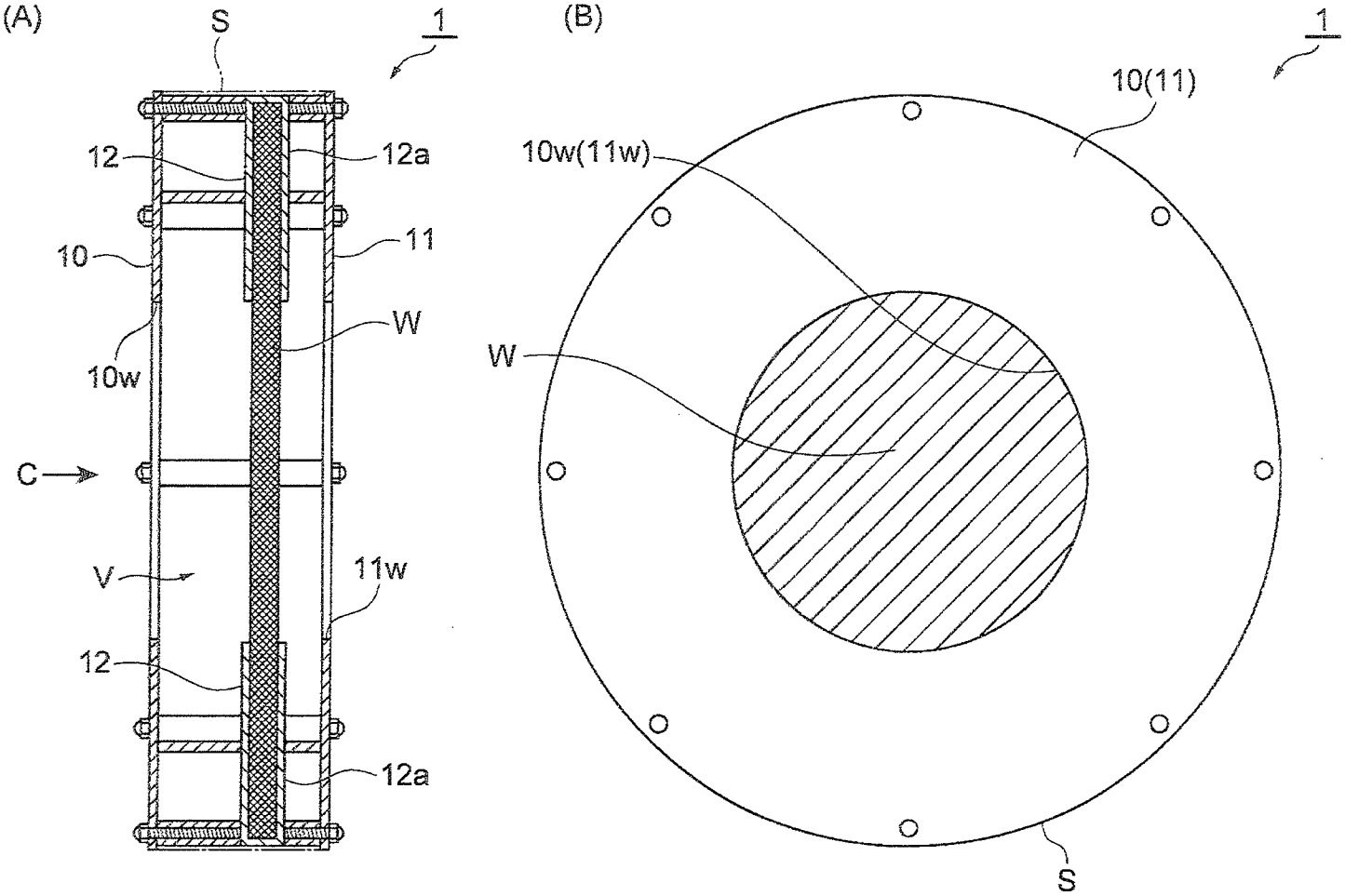

(A) of FIG. 4 illustrates a state where another example of a workpiece holding jig which holds a workpiece and is cut is viewed from the lateral side thereof and (B) of FIG. 4 illustrates a state where another example of the workpiece holding jig illustrated in (A) of FIG. 4 is viewed from a direction indicated by the arrow C of (A) of FIG. 4.

DESCRIPTION OF EMBODIMENTS

Embodiments of the invention will be described with reference to the drawings. However, each embodiments below is merely an example that describes the invention, and does not limit the invention by the content below. In the description, the same reference sign will be given to the same component or the component having the same function, and the repetitive description thereof will not be presented.

A workpiece holding jig 1 illustrated in FIG. 1 is a vibratory barreling jig configured to hold a workpiece W during a vibratory barreling operation. The workpiece W is a polishing target which is polished by a vibratory barreling device 2 (see FIG. 2). The workpiece W is formed in a flat shape having a large width with respect to a thickness. In FIG. 1, the workpiece W is a disk-shaped member that has a circular through hole formed at a center portion thereof. In the case of the large workpiece W, the diameter of the workpiece W may be, for example, 400 mm or more.

The workpiece holding jig 1 includes guard members 10 and 11, a holding member 12, a covering member 13, and an attachment member 14. The guard member 10 (the first guard member) is a disk-shaped member having an outer diameter shape larger than the workpiece W. The guard member 10 includes a circular center portion 10*a*, an annular peripheral edge 10*b*, and a plurality of linear connection portions 10*c*. The center portion 10*a*, the peripheral edge 10*b*, and the connection portions 10*c* are integrally formed.

The outer diameter of the center portion 10*a* is smaller than the inner diameter of the peripheral edge 10*b*. The peripheral edge 10*b* is located so as to surround the center portion 10*a*. The connection portion 10*c* connects the center portion 10*a* and the peripheral edge 10*b* to each other. Each connection portion 10*c* extends radially from the center of the center portion 10*a* in the radial direction.

A space which is surrounded by the center portion 10*a*, the peripheral edge 10*b*, and the connection portions 10*c* is a window portion 10*w* (a first window portion) which penetrates the guard member 10. In this embodiment, eight connection portions 10*c* are located at the substantially same interval in the circumferential direction of the guard member 10. Therefore, in this embodiment, the guard member 10 is provided with eight window portions 10*w*. In this embodiment, each window portions 10*w* is formed at a position corresponding to the polishing target area of the workpiece W which is held by the workpiece holding jig 1. Further, in (B) of FIG. 1, an area which is exposed from the window portion 10*w* in the workpiece W is indicated by the diagonal line.

The guard member 11 (the second guard member) is a disk-shaped member having an outer diameter shape larger than the workpiece W. The guard member 11 has the substantially same size as the guard member 10. The guard member 11 includes a circular center portion 11*a*, an annular peripheral edge 11*b*, and a plurality of linear connection portions 11*c*. The center portion 11*a*, the peripheral edge 11*b*, and the connection portions 11*c* are integrally formed.

The outer diameter of the center portion 11*a* is smaller than the inner diameter of the peripheral edge 11*b*. The peripheral edge 11*b* is located so as to surround the center portion 11*a*. The connection portion 11*c* connects the center portion 11*a* and the peripheral edge 11*b* to each other. Each connection portion 11*c* radially extends from the center of the center portion 11*a* in the radial direction.

A space which is surrounded by the center portion 11*a*, the peripheral edge 11*b*, and the connection portions 11*c* is a window portion 11*w* (a first window portion) which penetrates the guard member 11. In this embodiment, eight connection portions 11*c* are located at the substantially same interval in the circumferential direction of the guard member 11. Therefore, in this embodiment, the guard member 11 is provided with eight window portions 11*w*.

The guard member 10 and the guard member 11 are disposed so as to face each other. A columnar housing space V is formed between the guard member 10 and the guard member 11. An annular imaginary curved surface S is formed between the outer peripheral edge of the guard member 10 (the peripheral edge 10*b*) and the outer peripheral edge of the guard member 11 (the peripheral edge 11*b*) so as to connect these outer peripheral edges. In other words, the housing space V is a space which is surrounded by the guard members 10 and 11 and the imaginary curved surface S, and is an inner space of the workpiece holding jig 1. The workpiece holding jig 1 is formed in a flat columnar shape. The workpiece holding jig 1 may stand alone while the outer peripheral edges of the guard members 10 and 11 contact a floor surface or the like (the imaginary curved surface S faces the floor surface or the like).

The holding member 12 includes a holding portion 12*a* and an attachment plate 12*b*. The holding portion 12*a* is disposed in a space between the guard members 10 and 11, that is, a space inside the housing space V. The holding portion 12*a* clamps the inner peripheral edge of the workpiece W while being inserted into the through hole formed in the center portion of the workpiece W. Accordingly, the workpiece W is attached to the holding portion 12*a* (the holding member 12). The attachment plate 12*b* is disposed at each of the outer surfaces of the center portions 10*a* and 11*a*. When the center portions 10*a* and ha interposed between the holding portion 12*a* and the attachment plate 12*b* are fastened by a fastening member such as a bolt, the holding member 12 is fixed to the guard members 10 and 11.

Since the outer diameter shapes of the guard members 10 and 11 are larger than that of the workpiece W, the entire workpiece W attached to the holding portion 12*a* remains inside the housing space V while not protruding from the housing space V. In a state where the workpiece W is attached to the holding portion 12*a*, the center of gravity of the workpiece W may substantially match (completely match or be near) the center of gravity of the workpiece holding jig 1. In this case, the workpiece holding jig 1 which holds the workpiece W easily rolls on the floor surface or the like. In a state where the workpiece W is attached to the holding portion 12*a*, the main surface of the workpiece W faces each of the guard members 10 and 11.

The covering member 13 is formed in an annular shape. The covering member 13 is attached between the guard members 10 and 11 by the attachment member 14 while being sandwiched by the attachment member 14 from both sides in a facing direction of the guard members 10 and 11. Therefore, the guard members 10 and 11 are connected to each other through the covering member 13 and the attachment member 14. The covering member 13 surrounds the workpiece W while being attached to the guard members 10 and 11. At this time, the inner peripheral surface of the covering member 13 contacts the outer peripheral surface Wa of the workpiece W. Therefore, the outer peripheral surface Wa of the workpiece W is covered by the covering member 13 and is prevented from contacting with polishing media M to be described later. Thus, in this embodiment, the outer peripheral surface Wa of the workpiece W becomes a non-polishing area which is not polished by the polishing media M. The width of the covering member 13 may be larger than the thickness of the workpiece W and may be larger than the thickness of the workpiece W by, for example, 5/4 times.

Subsequently, a configuration of the vibratory barreling device 2 for polishing the workpiece W will be described with reference to FIG. 2. The vibratory barreling device 2 includes a barreling tank 20 which is opened upward. The barreling tank 20 stores a polishing solution and the polishing media M therein. Further, FIG. 2 is an enlarged diagram schematically illustrating the polishing media M in order to visually help the comprehension of the description.

The barreling tank 20 is formed by an outer wall having a U-shape as illustrated in (B) of FIG. 2. That is, the bottom wall of the barreling tank 20 has a circular-arc cross-section. Therefore, the polishing solution and the polishing media M inside the barreling tank 20 easily flow. Further, when the workpiece holding jig 1 is disposed inside the barreling tank 20 so that the imaginary curved surface S of the workpiece holding jig 1 contacts the bottom wall of the barreling tank 20, the workpiece holding jig 1 easily rolls inside the barreling tank 20.

As illustrated in (A) of FIG. 2, one or more partition plates 20*a*may be provided inside the barreling tank 20. In this case, when each workpiece holding jigs 1 is disposed at each of the rooms inside the barreling tank 20 defined by the partition plates 20*a*, the collision between the workpiece holding jigs 1 during the vibratory barreling is prevented. Further, the falling of the workpiece holding jig 1 is suppressed by the partition plate 20*a*, and hence the workpiece holding jig 1 easily stands alone.

The barreling tank 20 is placed on a pedestal 22 provided on the floor surface through a spring 21. Two bearings 23 are provided at the center of the bottom portion of the barreling tank 20 and are arranged in a predetermined direction. A rotation shaft 25 is inserted through such bearings 23. Therefore, the rotation shaft 25 is rotatably supported by the bearings 23. A counter weight 24 is fixed to the rotation shaft 25. The end of the rotation shaft 25 is fixed to a shaft of a motor 27 through a coupler 26.

A polishing solution supply device 28 is provided above the barreling tank 20 and supplies a predetermined amount of a polishing solution to the barreling tank 20. The bottom portion of the barreling tank 20 is provided with a draining port communicating with a draining pipe 29. A polishing solution including chips (polishing chip) is discharged from the draining port to the outside of the barreling tank 20 through the draining pipe 29.

Subsequently, a method of polishing the workpiece W held by the workpiece holding jig 1 by the use of the vibratory barreling device 2 will be described. First, the workpiece W is held by the workpiece holding jig 1. Next, each workpiece holding jig 1 is disposed at each room of the barreling tank 20 so that the imaginary curved surface S of the workpiece holding jig 1 contacts the bottom wall of the barreling tank 20. Next, a predetermined amount of the polishing media M is supplied to each room and the polishing solution is supplied from the polishing solution supply device 28 to each room. Next, the motor 27 is operated. When the motor 27 is operated, the counter weight 24 rotates through the rotation shaft 25, and the barreling tank 20 is shaken while drawing a substantially circular path in accordance with the rotation of the counter weight 24.

As illustrated in (B) of FIG. 2, when the motor 27 rotates the rotation shaft 25 in a direction indicated by the arrow R1, the barreling tank 20 is shaken, and the workpiece holding jig 1 rolls in a direction indicated by the arrow R2 while standing alone inside the barreling tank 20. At this time, the polishing media M flow inside the barreling tank 20. The polishing media M enter into the housing space V from the imaginary curved surface S along, for example, the arrow R3 and flows to the outside of the housing space V from the window portions 10*w* and 11*w* of the guard members 10 and 11 after the polishing media have been used to polish the workpiece W.

As another flow state, the polishing media M may flow into the housing space V from the imaginary curved surface S and may flow to the outside of the housing space V from the imaginary curved surface S after the polishing media have been used to polish the workpiece W. As another flow state, the polishing media M may flow into the housing space V from the window portions 10*w* and 11*w* of the guard members 10 and 11 and may flow to the outside of the housing space V from the imaginary curved surface S after the polishing media have been used to polish the workpiece W. As another flow state, the polishing media M may enter the housing space V from the window portions 10*w* and 11*w* of the guard members 10 and 11 and may flow to the outside of the housing space V from the window portions 10*w* and 11*w* of the guard members 10 and 11 after the polishing media have been used to polish the workpiece W.

When the workpiece W is completely polished in this way, the workpiece holding jig 1 is taken out from the barreling tank 20 and the workpiece W is separated from the workpiece holding jig 1. Subsequently, the workpiece W may be cleaned by flowing water. In a case where another workpiece W is polished, the above-described process is repeated while a new workpiece holding jig 1 holding the workpiece W which is not polished yet is disposed in the barreling tank 20. In a case where the workpiece holding jig 1 holding the polished workpiece W is replaced by a new workpiece holding jig 1, the driving of the motor 27 may be stopped or continued.

In a case where the polishing solution is used for the vibratory barreling, chips (polishing chips) remain in the polishing solution in accordance with the progress of the polishing operation, and hence the polishing efficiency may be degraded. In such a case, a flow-through system in which the polishing solution may be continuously or intermittently supplied from the polishing solution supply device 28 to the barreling tank 20 while the workpiece W is polished and the polishing operation may be performed while an extra polishing solution is discharged from the draining pipe 29 along with chips may be employed. In this case, it is possible to suppress excessive chips from remaining in the barreling tank 20 and to suppress the contamination inside the barreling tank 20. Therefore, it is possible to shorten the cleaning time for the barreling tank 20.

In the above-described embodiment, the holding member 12 holds the workpiece W inside the housing space V so that the entire workpiece W is located inside the housing space V surrounded by the disk-shaped guard members 10 and 11 each having an outer shape formed larger than the workpiece W and the annular imaginary curved surface S extending to connect the outer peripheral edges of the guard members 10 and 11 to each other. Therefore, the workpiece W remains inside the housing space V while not protruding from the workpiece holding jig 1. Thus, even when the workpiece holding jig 1 is disposed in the barreling tank 20 of the vibratory barreling device 2 and the barreling tank 20 is shaken by the vibratory barreling device 2, it is possible to prevent the collision between the workpiece W and the barreling tank 20. As a result, it is possible to suppress any defect by protecting the workpiece W when the workpiece W is polished by the vibratory barreling device 2.

In this embodiment, the guard members 10 and 11 each having an outer shape as a disk shape larger than the workpiece W are disposed so as to face each other. Therefore, the workpiece holding jig 1 has a columnar outer shape. Thus, when the workpiece holding jig 1 is disposed inside the barreling tank 20 while the workpiece holding jig 1 stands alone inside the barreling tank 20 so that the outer peripheral edges of the guard members 10 and 11 contact the bottom wall of the barreling tank 20, the workpiece holding jig 1 rolls while standing alone inside the barreling tank 20. Here, the guard members 10 and 11 are respectively provided with the window portions 10*w* and 11*w* communicating with the housing space V, and the imaginary curved surface S and the window portions 10*w* and 11*w* are configured to allow the polishing media M to pass between the inside and outside of the housing space V. Therefore, it is possible to cause the polishing media M to easily flow inside the workpiece holding jig 1 while causing the workpiece holding jig 1 to effectively roll. As a result, it is possible to polish the workpiece W with extremely high efficiency. In addition, since the workpiece W is polished while the workpiece holding jig 1 stands alone, it is possible to polish both surfaces of the workpiece W in a substantially uniform state.

Particularly, when the vibratory barreling is performed by using the above-described workpiece holding jig 1, it is possible to suppress any defect in the workpiece W and to polish both surfaces of the workpiece W in a substantially uniform state even when the workpiece W is large. As the large workpiece W, for example, a bearing holder, a gear, a vehicle wheel (e.g. a railway wheel), a pulley, or a blisk may be exemplified.

In this embodiment, the window portions 10*w* and 11*w* are formed at the positions facing a polishing target area for polishing by the polishing media M in the main surface of the workpiece W in the guard members 10 and 11. Therefore, the polishing media M pass through the window portions 10*w* and 11*w*, and are mainly guided to the polishing target area of the workpiece W. Thus, it is possible to efficiently polish the polishing target area of the workpiece W.

In this embodiment, the covering member 13 covers a non-polishing target area which is not polished by the polishing media M in the workpiece W. Therefore, there is no need to directly attach the covering member to the workpiece W at a position as the non-polishing area of the workpiece W. Thus, it is possible to set a desired non-polishing area just by holding the workpiece W in the workpiece holding jig 1.

In this embodiment, since the outer peripheral surface Wa of the workpiece W is covered by the covering member 13, the polishing media M hardly collide with the outer peripheral surface Wa of the workpiece W. Therefore, the shape of the outer peripheral surface Wa of the workpiece W hardly changes. Thus, it is possible to prevent a defect such as a dent or excessive polishing (edge dropping) in the vicinity of the peripheral edge of the workpiece W. In addition, when the vicinity of the peripheral edge of the workpiece W is excessively polished, the chamfered amount of the peripheral edge of the workpiece W becomes larger than a desired amount.

While the embodiment of the invention has been described in detail, the invention is not limited to the above-described embodiment. For example, in a case where the large workpiece W is polished by vibratory barreling, the polishing media M may be supplied to the barreling tank 20 so as to bury the entire workpiece W by the polishing media.

Meanwhile, when the workpiece holding jig 1 may stand alone while the imaginary curved surface S contacts the floor surface or the like as in the embodiment, there is no need to hold the workpiece holding jig 1 by the polishing media M or the like in order to cause the workpiece holding jig 1 to stand alone. In this case, the amount of the polishing media M may be decreased compared to the amount of the polishing media used in the general vibratory barreling. For example, the polishing media M may be supplied to the barreling tank 20 to a depth (about ⅓ to ½ of the diameter of the workpiece holding jig 1) of about ⅓ of the barreling tank 20.

The diameters of the guard members 10 and 11 may be 80% or less of the width of the barreling tank 20 so that the guard members sufficiently roll inside the barreling tank 20. A gap between the barreling tank 20 and the workpiece holding jig 1 may be set to, for example, 20 mm or more so that the polishing media M are not bitten between the barreling tank 20 and the workpiece holding jig 1.

The separation gap between the guard members 10 and 11 (the height of the imaginary curved surface S) or the dimensions of the window portions 10*w* and 11*w* may be set to three times or more the dimension of the polishing media M so that the polishing media M sufficiently flow between the inside and outside of the workpiece holding jig 1. In a state where the workpiece W is held by the workpiece holding jig 1, a gap between the workpiece W and each of the inner wall of the guard member 10 and the inner wall of the guard member 11 may be set to three times or more the dimension of the polishing media M so that the polishing media M sufficiently flow between the inside and outside of the workpiece holding jig 1. The width of the workpiece holding jig 1 (the height of the imaginary curved surface S) may be set to ¼ or more of the diameters of the guard members 10 and 11 so that the workpiece holding jig 1 stably stands alone.

The workpiece holding jig 1 may not include the covering member 13 in order to polish the outer peripheral surface Wa of the workpiece W. At this time, the distance between the imaginary curved surface S and the outer peripheral surface Wa may be set to two times or more the dimension of the polishing media M. The flow of the polishing media M in the vicinity of the outer peripheral edge of the workpiece W is not easily disturbed. Thus, it is possible to efficiently polish even the outer peripheral edge of the workpiece W.

As illustrated in (A) of FIG. 3, the guard members 10 and 11 may be connected to each other by a connection member 15 extending between the peripheral edges thereof. The connection member 15 includes an annular portion 15*a* extending in the circumferential direction of the guard members 10 and 11 and a beam portion 15*b* extending linearly in the facing direction of the guard members 10 and 11. The inner peripheral surface of the annular portion 15*a* contacts the outer peripheral surface Wa of the workpiece W. The beam portion 15*b* connects the annular portion 15*a* between the guard members 10 and 11. Therefore, a space surrounded by the annular portion 15*a* and the beam portion 15*b* is a window portion 15*w* (a second window portion) penetrating the connection member 15. The window portion 15*w* communicates between the inside and the outside of the housing space V.

In this case, the guard members 10 and 11 are integrated with each other by the connection member 15. Therefore, the strength of the workpiece holding jig 1 may be improved. Further, since the connection member 15 is provided with the window portion 15*w*, the window portion 15*w* is configured to allow the polishing media M to pass between the inside and outside of the housing space V. Therefore, the polishing media M may easily flow inside the workpiece holding jig 1. As a result, the workpiece W may be polished extremely efficiently.

The number, the shape, the dimension or the like of each of the window portions 10*w*, 11*w*, and 15*w* may be voluntarily set as long as the polishing media M may be guided by the window portions 10*w*, 11*w*, and 15*w* so that the polishing media M collide with the polishing target area of the workpiece W. For example, as illustrated in (B) of FIG. 3, the guard members 10 and 11 may be provided with four window portions 10*w* and 11*w* which are deviated from each other by 90°.

The covering member 13 may be provided so as to cover not only the outer peripheral surface Wa of the workpiece W but also the non-polishing target area which is not polished by the polishing media M in the workpiece W. The number, the shape, the dimension or the like of the non-polishing target area may be voluntarily set. For example, the covering member 13 which covers the center portion may be employed in a case where only the peripheral edge of the workpiece W is polished instead of the center portion of the workpiece W.

FIG. 4 illustrates an example of the workpiece holding jig 1 in a case where only the center portion of the workpiece W is polished. The holding member 12 of FIG. 4 is an annular member that has a space therein, and the inner peripheral surface thereof is opened. The holding member 12 covers and holds the peripheral edge of the workpiece W without a through hole. Therefore, the center portion of the workpiece W is exposed when the workpiece W is fixed to the holding member 12. At this time, the window portions 10*w* and 11*w* are formed at the center portions of the guard members 10 and 11. When the workpiece holding jig 1 with such a configuration is used, the polishing media M are guided from the window portions 10*w* and 11*w* to the center portion of the workpiece W. For this reason, the peripheral edge of the workpiece W is not polished, and only the center portion of the workpiece W is polished.

As illustrated in FIGS. 1 and 3, the window portions 10*w* and 11*w* may be provided at a plurality of positions so as to be arranged along the circumferential direction in the peripheral edges of the guard members 10 and 11. As illustrated in (B) of FIG. 4, the window portions 10*w* and 11*w* may be provided, at one position of the center portions of the guard members 10 and 11.

The shape of the workpiece W is not particularly limited as long as the workpiece is flat. For example, the workpiece may be formed in a flat plate shape, an annular shape, or a frame shape other than the disk shape. The shape of the holding member 12 or the position of holding the workpiece W by the holding member 12 may be appropriately changed in accordance with the shape of the workpiece W and the polishing target area or the like.

The installation position of the covering member 13 is not particularly limited. For example, the covering member 13 may be attached to the holding member 12.

EXAMPLES

Hereinafter, examples of a vibratory barreling method according to the invention will be described, but the invention is not limited to these examples. As the workpiece holding jig 1, a workpiece holding jig having a shape substantially similar to FIG. 1 was prepared. The diameters of the guard members 10 and 11 were about 840 mm. The width of the workpiece holding jig 1 in the facing direction of the guard members 10 and 11 was about 213 mm (¼ or more of the outer diameter). The width of the covering member 13 was about 50 mm (5/4times the width of the workpiece W). As for the dimensions of the window portions 10*w* and 11*w*, the lengths of the first and second edges extending linearly in the radial direction and separately arranged in the circumferential direction were about 180 mm, the length of the third edge extending in a circular-arc shape in the circumferential direction and connecting the first and second edges at the peripheral edges 10*b* and 11*b* side was about 240 mm, and the length of the fourth edge extending in a circular arc-shape in the circumferential direction and connecting the first and second edges at the center portions 10*a* and 11*a* side was about 100 mm.

As the workpiece W, a disk-shaped member having a diameter of about 800 mm and a thickness of about 40 mm was prepared. The workpiece W was formed of titanium. As the polishing media M, sintered media (manufactured by SINTOKOGIO, LTD.) which are cut into a triangular prism having an edge of about 10 mm and a length of about 7 mm respectively were prepared.

As the vibratory barreling device 2, a device obtained by modifying VF-1423 W manufactured by SINTOKOGIO, LTD. was prepared. The dimension of the barreling tank 20 was set so that the width was about 800 mm, the length was about 1000 mm, and the height was about 800 mm. The center portion of the barreling tank 20 was provided with the partition plate 20*a*. Then, the above-described polishing media M were supplied to the barreling tank 20 so as to fill ⅓ of the volume. As the polishing solution, a solution obtained by adding a compound (GLM-4 manufactured by SINTOKOGIO, LTD.) of 0.5% to tap water was prepared. The polishing solution was supplied at about 400 ml per minute.

(1) Evaluation of Outer Peripheral Surface Wa of Workpiece W

The workpiece W was polished for six hours by the vibratory barreling device 2, and ten points were voluntarily selected at the front and rear surfaces of the outer peripheral surface Wa of the workpiece W so as to observe the ten points by a non-contact three-dimensional shape measuring device (TDS-2100 CG manufactured by Technomu Co., Ltd). Further, the diameter of the workpiece W was measured at the voluntary ten points by a ling-size caliper, and was compared with the diameter of the workpiece W which was not polished. As a result, a change in shape such as distortion or dent was not found in any point of the outer peripheral surface Wa of the workpiece W. As a result, it was found that the outer peripheral surface Wa of the workpiece W was not polished by the covering member 13.

(2) Evaluation of Polishing Progress and Unevenness of Polishing

Three points were voluntarily selected in the front and rear surfaces to be polished in the non-polished workpiece W, and the surface roughness Ra (HS (Japanese Industrial Standards) B6001:1994) thereof was measured by a surface roughness measurement device (SURFCOM 130A manufactured by TOKYO SEIMITSU CO., LTD.). Further, the surface roughness Ra of the polished workpiece W was measured in this way. The polishing progress and the unevenness of the polishing were evaluated by the comparison of these measurement values. The average value of the surface roughness Ra of the non-polished workpiece W was about 1.49 μm at the front surface and was about 1.52 μm at the rear surface. Further, the average value of the surface roughness Ra of the polished workpiece W was about 0.23 μm at the front surface and was about 0.21 μm at the rear surface. Accordingly, it was found that both surfaces were satisfactorily polished. Further, in the polished workpiece W, the unevenness for the average value of the surface roughness Ra was within ±10% at both the front and rear surfaces. As a result, it was found that both surfaces were polished with little unevenness of the polishing.

(3) Evaluation of Modification

In the polished workpiece W, ten points were voluntarily selected in the front and rear surfaces as the polished positions, and the shapes thereof were measured by the above-described non-contact three-dimensional shape measurement device. As a result, any deformation caused by the polishing was not found in any measurement position.

As described above, the following facts were found when the vibratory barreling was performed on the flat workpiece W by using the workpiece holding jig 1 of the embodiment. That is, (a) the polishing position may be voluntarily set, (b) the workpiece may be uniformly polished with little unevenness of the polishing, and (c) the workpiece W may be polished without any deformation of the workpiece W.

REFERENCE SIGNS LIST

1: workpiece holding jig
2: vibratory barreling device
10, 11: guard member
10*w*, 11*w*: window portion
12: holding member
13: covering member
14: attachment member
20: barreling tank
M: polishing media
S: imaginary curved surface
V: housing space
W: workpiece

The invention claimed is:

1. A workpiece holding jig for vibratory barreling configured to hold a flat workpiece when the workpiece is polished by a vibratory barreling device using polishing media, the workpiece holding jig comprising:

disk-shaped first and second guard members each having an outer shape larger than the workpiece and disposed so as to face each other;

a holding member holding the workpiece inside a housing space so that the entire workpiece is located inside the columnar housing space surrounded by the first guard member, the second guard memberand an annular imaginary curved surface extending connecting the peripheral edges of the first and second guard members; and a connection member extending between the peripheral edges of the first and second guard members and connecting the first and second guard members to each other, wherein each of the first and second guard members is provided with a first window portion communicating with the housing space, wherein the imaginary curved surface and the first window portion are configured to allow the polishing media to pass between the inside and outside of the housing space, wherein the connection member is provided with a second window portion communicating with the housing space, and wherein the second window portion is configured to allow the polishing media to pass between the inside and outside of the housing space.

2. The workpiece holding jig according to claim 1, wherein the holding member holds the workpiece so that the main surface of the workpiece faces each of the first and second guard members, and wherein the first window portion is formed at a position facing a polishing target area for polishing by the polishing media in the main surface of the workpiece.

3. The workpiece holding jig according to claim 1, further comprising a covering member covering a non-polishing target area not polished by the polishing media in the workpiece.

4. The workpiece holding jig according to claim 2, further comprising a covering member covering a non-polishing target area not polished by the polishing media in the workpiece.

5. The workpiece holding jig according to claim 1, wherein a gap between the peripheral edge of the workpiece and the imaginary curved surface is set to be larger than the outer shape of the polishing media.

6. The workpiece holding jig according to claim 2, wherein a gap between the peripheral edge of the workpiece and the imaginary curved surface is set to be larger than the outer shape of the polishing media.

7. The workpiece holding jig according to claim 3, wherein a gap between the peripheral edge of the workpiece and the imaginary curved surface is set to be larger than the outer shape of the polishing media.

8. The workpiece holding jig according to claim 4, wherein a gap between the peripheral edge of the workpiece and the imaginary curved surface is set to be larger than the outer shape of the polishing media.

9. A vibratory barreling method comprising:

holding the workpiece in the holding member of the workpiece holding jig according to claim 1;

disposing the workpiece holding jig inside a barreling tank while the workpiece holding jig stands alone inside the barreling tank so that the peripheral edges of the first and second guard members contact the bottom wall of the barreling tank of the vibratory barreling device; and causing the vibratory barreling device to shake the barreling tank so that the polishing media flow between the inside and outside of the housing space through the imaginary curved surface and the first window portion while the workpiece holding jig rolls inside the barreling tank in a state where the workpiece holding jig stands alone inside the barreling tank.

10. A vibratory barreling method comprising:

holding the workpiece in the holding, member of the workpiece holding jig according to claim 2;

disposing the workpiece holding jig inside a barreling tank while the workpiece holding jig stands alone inside the barreling tank so that the peripheral edges of the first and second guard members contact the bottom wall of the barreling tank of the vibratory barreling device; and causing the vibratory barreling device to shake the barreling tank so that the polishing media flow between the inside and outside of the housing space through the imaginary curved surface and the first window portion while the workpiece holding jig rolls inside the barreling tank in a state where the workpiece holding jig stands alone inside the barreling tank.

11. A vibratory barreling method comprising:

holding the workpiece in the holding member of the workpiece holding jig according to claim 3;

disposing the workpiece holding jig inside a barreling tank while the workpiece holding jig stands alone inside the barreling tank so that the peripheral edges of the first and second guard members contact the bottom wall of the barreling tank of the vibratory barreling device; and causing the vibratory barreling device to shake the barreling tank so that the polishing media flow between the inside and outside of the housing space through the imaginary curved surface and the first window portion while the workpiece holding jig rolls inside the barreling tank in a state where the workpiece holding jig stands alone inside the barreling tank.

12. A vibratory barreling method comprising:

holding the workpiece in the holding member of the workpiece holding jig according to claim 4;

disposing the workpiece holding jig inside a barreling tank while the workpiece holding jig stands alone inside the barreling tank so that the peripheral edges of the first and second guard members contact the bottom wall of the barreling tank of the vibratory barreling device; and causing the vibratory barreling device to shake the barreling tank so that the polishing media flow between the inside and outside of the housing space through the imaginary curved surface and the first window portion while the workpiece holding jig rolls inside the barreling tank in a state where the workpiece holding jig stands alone inside the barreling tank.

13. A vibratory barreling method comprising:

holding the workpiece in the holding member of the workpiece holding jig according to claim 5;

disposing the workpiece holding jig inside a barreling tank while the workpiece holding jig stands alone inside the barreling tank so that the peripheral edges of the first and second guard members contact the bottom wall of the barreling tank of the vibratory barreling device; and causing the vibratory barreling device to shake the barreling tank so that the polishing media flow between the inside and outside of the housing space through the imaginary curved surface and the first window portion while the workpiece holding jig rolls inside the barreling tank in a state where the workpiece holding jig stands alone inside the barreling tank.

14. A vibratory barreling method comprising:

holding the workpiece in the holding member of the workpiece holding according to claim 6;

disposing the workpiece holding jig inside a barreling tank while the workpiece holding jig stands alone inside the barreling tank so that the peripheral edges of the first and second guard members contact the bottom wall of the barreling tank of the vibratory barreling device; and causing the vibratory barreling device to shake the barreling tank so that the polishing media flow between the inside and outside of the housing space through the imaginary curved surface and the first window portion while the workpiece holding jig rolls inside the barreling tank in a state where the workpiece holding jig stands alone inside the barreling tank.

15. A vibratory barreling method comprising:

holding the workpiece in the holding member of the workpiece holding jig according to claim 7;

disposing the workpiece holding jig inside a barreling tank while the workpiece holding jig stands alone inside the barreling tank so that the peripheral edges of the first and second guard members contact the bottom wall of the barreling tank of the vibratory barreling device; and causing the vibratory barreling device to shake the barreling tank so that the polishing media flow between the inside and outside of the housing space through the imaginary curved surface and the first window portion while the workpiece holding jig rolls inside the barreling tank in a state where the workpiece holding jig stands alone inside the barreling tank.

16. A vibratory barreling method comprising:

holding the workpiece in the holding member of the workpiece holding jig according to claim 8;

disposing the workpiece holding jig inside a barreling tank while the workpiece holding jig stands alone inside the barreling tank so that the peripheral edges of the first and second guard members contact the bottom wall of the barreling tank of the vibratory barreling device; and causing the vibratory barreling device to shake the barreling tank so that the polishing media flow between the inside and outside of the housing space through the imaginary curved surface and the first window portion while the workpiece holding jig rolls inside the barreling tank in a state where the workpiece holding jig stands alone inside the barreling tank.

* * * * *